US012473659B2

(12) United States Patent
Kaushal et al.

(10) Patent No.: US 12,473,659 B2
(45) Date of Patent: Nov. 18, 2025

(54) CONFORMAL YTTRIUM OXIDE COATING

(71) Applicant: Applied Materials, Inc., Santa Clara, CA (US)

(72) Inventors: Tony S. Kaushal, Campbell, CA (US); Michelle Lacomb Novak, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 212 days.

(21) Appl. No.: 17/350,553

(22) Filed: Jun. 17, 2021

(65) Prior Publication Data

US 2022/0403531 A1 Dec. 22, 2022

(51) Int. Cl.

| | |
|---|---|
| ***C25D 11/18*** | (2006.01) |
| ***C23C 28/00*** | (2006.01) |
| ***C25D 11/02*** | (2006.01) |

(52) U.S. Cl.

CPC ..... *C25D 11/18* (2013.01); *C23C 28/00* (2013.01); *C25D 11/026* (2013.01)

(58) Field of Classification Search

None

See application file for complete search history.

(56) References Cited

U.S. PATENT DOCUMENTS

| | | | | |
|---|---|---|---|---|
| 2006/0118045 | A1 | 6/2006 | Fink | |
| 2011/0005922 | A1* | 1/2011 | Tai | C25D 11/04 204/298.07 |
| 2014/0318974 | A1* | 10/2014 | Curran | C25D 11/24 205/171 |
| 2020/0152426 | A1* | 5/2020 | Doh | C25D 11/06 |

FOREIGN PATENT DOCUMENTS

| | | | | |
|---|---|---|---|---|
| JP | WO2005118919 | * | 12/2005 | C25D 11/02 |
| JP | 2014-194080 | A | 10/2014 | |
| JP | 2018150617 | A | 9/2018 | |
| JP | 2020504241 | A | 2/2020 | |
| KR | 101877017 | B1 | 7/2018 | |
| TW | 202020209 | A | 6/2020 | |

(Continued)

OTHER PUBLICATIONS

Yu et al. "Effect of rare earth Y2O3 on the corrosion and friction properties of Al2O3 ceramic coatings prepared via microarc oxidation" Inter. Journal of Electrochemical Science (2020) (Year: 2020).*

Curran et al. "Porosity in plasma electrolytic oxide coatings" Acta Materialia 54 (2006) (Year: 2006).*

International Search Report and Written Opinion mailed on Sep. 15, 2022 in International Patent Application No. PCT/US2022/031989, 11 pages.

(Continued)

*Primary Examiner* — Mandy C Louie

(74) *Attorney, Agent, or Firm* — Kilpatrick Townsend & Stockton LLP

(57) ABSTRACT

Exemplary methods of coating a semiconductor component substrate may include submerging the semiconductor component substrate in an alkaline electrolyte. The alkaline electrolyte may include yttrium. The methods may include igniting a plasma at a surface of the semiconductor component substrate for a period of time less than or about 12 hours. The methods may include forming a yttrium-containing oxide on the semiconductor component substrate. A surface of the yttrium-containing oxide may be characterized by a yttrium incorporation of greater than or about 10 at. %.

19 Claims, 3 Drawing Sheets

(56) References Cited

FOREIGN PATENT DOCUMENTS

| | | | | |
|---|---|---|---|---|
| TW | 202116426 | A | 5/2021 | |
| WO | WO-2010053687 | A2 * | 5/2010 | ..... C23C 4/02 |
| WO | WO-2010073916 | A1 * | 7/2010 | ..... C25D 11/024 |
| WO | WO-2020023302 | A1 * | 1/2020 | ..... C23C 16/045 |

OTHER PUBLICATIONS

International Preliminary Report on Patentability mailed on Dec. 28, 2023 in International Patent Application No. PCT/US2022/031989, 7 pages.
JP2023-577667, "Office Action", Mar. 25, 2025, 11 pages.
Korean Application No. 10-2024-7001377, Office Action mailed on Aug. 18, 2025, 10 pages (3 pages of English Translation and 7 pages of Original Copy).
Japanese Application No. 2023-577667, Office Action mailed on Sep. 2, 2025, 8 pages (4 pages of English Translation and 4 pages of Original Copy).

* cited by examiner

CONFORMAL YTTRIUM OXIDE COATING

TECHNICAL FIELD

The present technology relates to processes and systems for coating components. More specifically, the present technology relates to systems and methods for coating a substrate with a conformal yttrium oxide coating.

BACKGROUND

Semiconductor processing systems may include a number of components used to support substrates, deliver formation materials and removal materials, and define processing regions and flow paths. These components may be exposed to high and low temperatures, high and low pressures, and a variety of corrosive and erosive materials. Accordingly, many processing chambers include treated or coated materials. However, as processing systems and chambers become more complex, the components incorporated within the system may become multi-piece apparatuses that may include complex geometries and features across the components. These features may similarly be exposed to environmental conditions and materials that can cause damage to the components.

Thus, there is a need for improved systems and components that can be used to produce high quality devices and structures. These and other needs are addressed by the present technology.

SUMMARY

Exemplary methods of coating a semiconductor component substrate may include submerging the semiconductor component substrate in an alkaline electrolyte. The alkaline electrolyte may include yttrium. The methods may include igniting a plasma at a surface of the semiconductor component substrate for a period of time less than or about 12 hours. The methods may include forming a yttrium-containing oxide on the semiconductor component substrate. A surface of the yttrium-containing oxide may be characterized by a yttrium incorporation of greater than or about 10 at. %.

In some embodiments, the semiconductor component substrate may be or include aluminum 6061. The yttrium incorporation in the yttrium-containing oxide may be maintained above or about 10 at. % through at least one third of a depth of the yttrium-containing oxide. The yttrium-containing oxide on the semiconductor component substrate may be characterized by a Vickers hardness of greater than or about 1000. The yttrium-containing oxide on the semiconductor component substrate may be characterized by a dielectric breakdown voltage of greater than or about 20 V/μm. The yttrium-containing oxide formed may include pores characterized by an average pore diameter of less than or about 100 nm. The methods may include forming a yttrium-containing layer on the yttrium-containing oxide by an atomic layer deposition process to produce a combination coating on the semiconductor component substrate. The yttrium-containing layer may be characterized by a thickness of less than or about 100 nm. The combination coating on the semiconductor component substrate may be characterized by a dielectric breakdown voltage of greater than or about 50 V/μm. The methods may include removing an amount of the yttrium-containing oxide across a surface of the semiconductor component substrate. The yttrium-containing oxide across the surface may be characterized by an average roughness of less than or about 0.5 μm.

Some embodiments of the present technology may encompass methods of coating a semiconductor component substrate. The methods may include submerging the semiconductor component substrate in an alkaline electrolyte. The alkaline electrolyte may include yttrium. The methods may include igniting a plasma at a surface of the semiconductor component substrate for a period of time less than or about 12 hours. The methods may include forming a yttrium-containing oxide on the semiconductor component substrate. The yttrium-containing oxide may be characterized by a thickness of greater than or about 50 μm. A yttrium incorporation in the yttrium-containing may be maintained above or about 10 at. % through at least one third of a depth of the yttrium-containing oxide. The methods may include polishing a surface of the yttrium-containing oxide across the semiconductor component substrate. The surface of the yttrium-containing oxide across the semiconductor component substrate may be characterized by an average roughness of less than or about 0.5 μm. The methods may include forming a yttrium-containing layer on the yttrium-containing oxide by an atomic layer deposition process to produce a combination coating on the semiconductor component substrate. The yttrium-containing layer on the yttrium-containing oxide may be characterized by a thickness of less than or about 100 nm. The combination coating on the semiconductor component substrate may be characterized by a dielectric breakdown voltage of greater than or about 50 V/μm.

Some embodiments of the present technology may encompass coated semiconductor components. The components may include an aluminum substrate. The components may include a conformal coating extending across the aluminum substrate. The conformal coating may be characterized by a yttrium oxide and aluminum oxide crystalline structure. The yttrium oxide and aluminum oxide crystalline structure may include at least 2% yttrium aluminum monoclinic. The conformal coating may be characterized by a thickness of greater than or about 20 μm. The conformal coating may be characterized by a dielectric breakdown voltage of greater than or about 35 V/μm. In some embodiments, the conformal coating may include a first conformal coating, and the coated semiconductor component may also include a second conformal coating overlying the first conformal coating. The second conformal coating may be characterized by a thickness of less than or about 100 nm.

Such technology may provide numerous benefits over conventional systems and techniques. For example, the present technology may form conformal coatings that may adapt to a variety of component configurations and geometries. Additionally, the present technology may produce coatings characterized by increased thicknesses and material properties compared to conventional coatings. These and other embodiments, along with many of their advantages and features, are described in more detail in conjunction with the below description and attached figures.

BRIEF DESCRIPTION OF THE DRAWINGS

A further understanding of the nature and advantages of the disclosed technology may be realized by reference to the remaining portions of the specification and the drawings.

Figure 1:
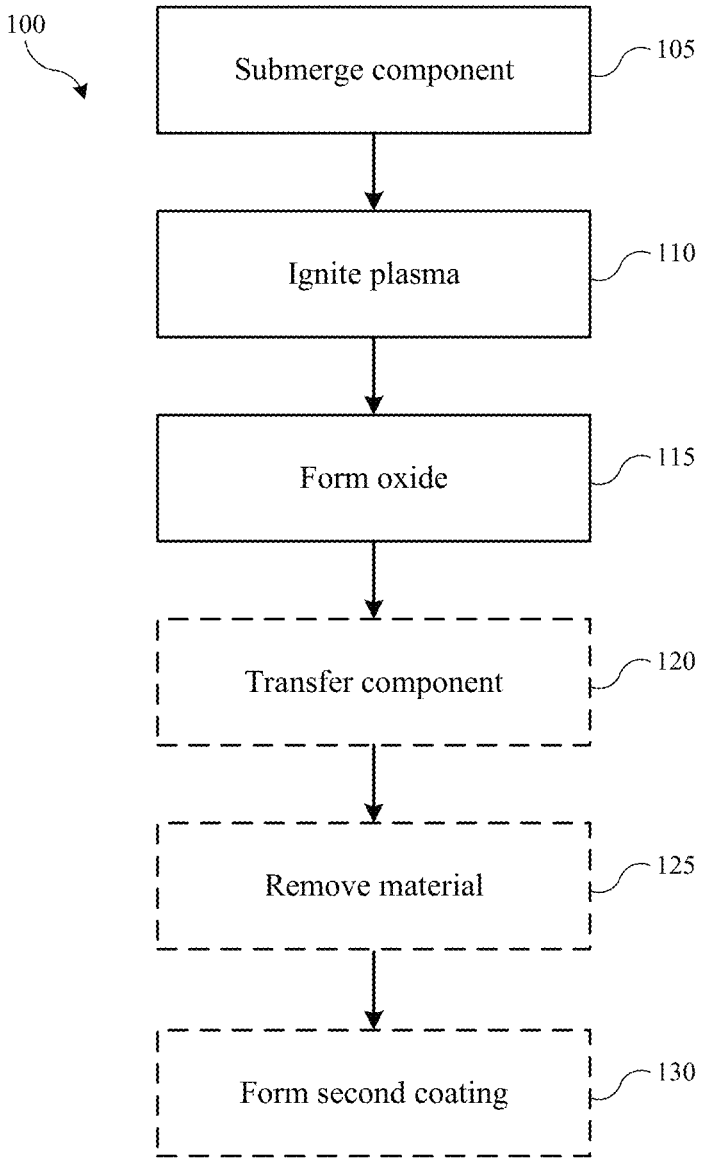
FIG. 1 shows selected operations in a method of cooling a component according to some embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the letter.

DETAILED DESCRIPTION

Semiconductor processing may include a number of operations that produce intricately patterned material on a substrate. The operations may include a number of formation and removal processes, which may utilize corrosive or erosive materials, including plasma-enhanced materials formed either remotely or at the substrate level. For example, a halogen-containing gas may be flowed into a processing region where the gas or plasma effluents of the material contacts a substrate positioned within the region. While the etchant may preferentially etch the substrate material, the chemical etchant may also contact other components within the chamber. The etchant may chemically attack the components, and depending on the process performed, one or more of the components may be bombarded with plasma effluents, which may also erode components. The chemical and physical damage to the chamber components caused by the etchant may cause wear over time, which may increase replacement costs and down time for the chamber.

Deposition processes similarly may use plasma enhanced processes to form or deposit materials on substrates, which may also be deposited on chamber components. This may require cleaning operations once a substrate has been removed from the chamber. Cleaning processes may include utilizing one or more halogen-containing precursors or plasma effluents of these precursors to remove material deposited on surfaces in the processing chamber. While the cleaning may target deposited material, many exposed chamber component surfaces may be similarly attacked. For example, once the substrate has been removed from the processing chamber, a central region of the substrate support will be exposed with no residual deposition material. The cleaning process may begin to form pitting or other removal of the substrate support, which may reduce planarity, as well as integrity for a chuck. Many of these chamber components include multiple pieces bonded together to produce channels, flow paths, or sealed regions within the component. Individual pieces or a combination apparatus component within the chamber may be characterized by any number of internal features, including channels, apertures, and a variety of other topographies.

Conventional technologies have struggled to limit both corrosion and erosion to chamber components, and tend to replace components regularly due to the damage caused by one or both of these mechanisms. Although some processes may include a seasoning process prior to the semiconductor substrate processing, this may cause additional challenges. For example, seasoning processes may cover portions of the substrate support, but may not fully cover a backside or stem, and thus components of a substrate support, such as a baseplate or stem, may still be exposed to process and cleaning materials. Additionally, seasoning processes typically deposit a hundred nanometers of coating or less. This may require the seasoning to be replaced for each substrate being processed, which may increase queue times, and may also reduce the likelihood of a uniform or complete coverage. Conventional technologies have attempted to protect many of these components with coatings that may be less reactive to corrosive materials, and/or may be more capable of withstanding plasma bombardment.

However, many of these conventional coatings may be characterized by limitations. For example, conventional technologies may utilize plasma-sprayed coatings, which may coat components in oxide or other protective materials. Plasma-spray techniques are performed with line-of-sight spraying, and are not capable of penetrating features or apertures of many components. This may leave exposed surfaces, which may still degrade over time, and may also produce a non-uniform coating, which may be more likely to break down during plasma formation. Conventional technologies may also utilize coatings formed by atomic-layer deposition. Although these coatings may be characterized by a conformal coverage of the component, the coatings are typically characterized by reduced thickness due to the length of time atomic-layer deposition requires to produce coverage. Additionally, atomic-layer deposition may be limited to producing amorphous coatings, which may not be characterized by the hardness of a crystalline structure. Accordingly, coatings of hundreds of nanometers or less, which can be produced by atomic-layer deposition, are more likely to be eroded or degraded, which may limit component protection and may increase downtime to replace components for which the coating has been reduced or removed.

The present technology overcomes these issues by coating chamber components prior to substrate processing. For example, components may be completely coated on surfaces exposed within a semiconductor processing chamber. Additionally, the coatings may be characterized by increased thicknesses, which may improve both complete coverage, as well as allowing the component to be used in processing a number of wafers before the component is replaced. Although the remaining disclosure will routinely identify specific materials and components utilizing aspects of the disclosed technology, it will be readily understood that the systems, methods, and materials are equally applicable to a variety of other devices and processes as may occur in semiconductor processing systems, or in other fabrication in which coated components may be used. Accordingly, the technology should not be considered to be so limited as for use with the described components and processes alone. The disclosure will discuss non-limiting operations of exemplary processes as well as discuss general components that may be coated according to embodiments of the present technology.

Turning to FIG. 1 is shown selected operations in a method 100 of coating a semiconductor component substrate according to some embodiments of the present technology. Many operations of method 100 may be performed, for example, in any number of chambers or systems, including oxidation chambers and atomic-layer deposition chambers, as well as any combination of systems discussed, or which may be configured to perform operations as discussed for method 100. Method 100 may include one or more operations prior to the initiation of the method, including processing to produce or prepare one or more parts or pieces which may be bonded, as well as components that have been bonded already. For example, upstream processing may include casting or treating metal components, as well as preparing one or more surfaces for coating operations. The method may include a number of optional operations as denoted in the figure, which may or may not be specifically associated with the method according to the present technology. For example, many of the operations are described in order to provide a broader scope of the coating operations, but are not critical to the technology, or may be performed by alternative methodology as will be discussed further below.

As discussed throughout the present disclosure, substrates according to embodiments of the present technology may be or include any number of components or component sections. For example, exemplary component substrates in semiconductor processing systems may include any component incorporated in a semiconductor processing system that may include materials produced that may be exposed to a plasma or other processing environment. For example, substrate support components, such as baseplates or edge rings, fluid delivery components, such as showerheads or lid plates, structural components, such as spacers or liners, as well as any other single or multi-piece component may be coated according to embodiments of the present technology. The components may be substantially planar, or may include complex geometries, which may include channels, apertures, or other features across one or more surfaces of the components. The components may be made of any number of materials, which may be or include aluminum, carbon, chromium, copper, iron, magnesium, manganese, nickel, silicon, titanium, or zinc. The components may be or include alloys, such as aluminum alloys, which may include any number of materials. Exemplary alloys may include any known aluminum alloy, including alloys from the 1xxx series, the 2xxx series, the 3xxx series, the 4xxx series, the 5xxx series, the 6xxx series, or the 7xxx series. Although the discussion below may reference aluminum 6061, from which components according to embodiments of the present technology may be made, it is to be understood that the present technology may be employed with any aluminum alloy, as well as alloys of any number of other metals that may be used in semiconductor processing chambers or systems.

Method 100 may include submerging the substrate in an electrolyte at operation 105. The substrate may be or include any semiconductor processing system component, as noted above, and the electrolyte may be any suitable electrolyte for a plating operation, such as may include plasma electrolytic oxidation, for example. At operation 110, a plasma may be ignited at the surface of the component in order to form an oxide coating. The process may be continued for a period of time in which an oxide coating may be formed at operation 115 on the component, and which may be a yttrium-oxide-containing coating in some embodiments, and which may be a combination of yttrium oxide and aluminum oxide in some embodiments. Conventional plasma electrolytic oxidation technologies often produce coatings characterized by excessive cracking or deep pores through the material, which may lead to flaking and removal of the coating. The present technology may utilize pulsed currents and a modified bath to produce oxide coatings on the components. The process may be performed to operate in a plasma-discharge regime and limit arcing.

To produce denser coatings according to some embodiments of the present technology, high-frequency, short duration pulsing may be applied, which may increase current density and plasma temperature of the formation. This may form denser coatings, and may resolve formation of flaking layers of material. For example, in some embodiments the pulsing frequency may be greater than or about 1 kHz, and may be greater than or about 2 kHz, greater than or about 3 kHz, greater than or about 4 kHz, greater than or about 5 kHz, greater than or about 6 kHz, greater than or about 7 kHz, greater than or about 8 kHz, greater than or about 9 kHz, greater than or about 10 kHz, or more. Pulse durations may be less than or about 1 millisecond, and may be less than or about 0.5 millisecond, less than or about 0.1 milliseconds, less than or about 0.05 milliseconds or less. This may produce a current density that may exceed 100 $A/dm^2$, and which may produce temperatures at the surface where formation is occurring of greater than or about 200° C., and which may be greater than or about 250° C., greater than or about 300° C., greater than or about 350° C., greater than or about 400° C., greater than or about 450° C., greater than or about 500° C., or higher. This may produce a more dense crystalline structure, which may be further controlled in operation to produce specific crystalline forms of yttrium-containing oxides.

The electrolyte may be an alkaline electrolyte, such as may be characterized by a pH of greater than or about 9, and which may include one or more materials. For example, an aqueous potassium hydroxide bath may be used as the electrolyte in which one or more additives may be included. The bath may be agitated during deposition operations, which may facilitate mixing as well as deposition. In some embodiments, the additive may be a yttrium-containing material, which may be soluble in the electrolyte, and may produce yttrium ions in some embodiments. For example, yttrium nitrate may be added to the aqueous solution, which may provide a source of yttrium for the deposition.

Conventional formations may have limited yttrium incorporation to a lower concentration than the potassium hydroxide concentration, which may lower the amount of yttrium incorporation, and may limit the inclusion to an outer layer of the coating. The present technology, however, may increase the ratio to include yttrium component incorporation of greater than or about the potassium component incorporation, such as greater than or about 1:1, and which may be greater than or about 1.1:1, greater than or about 1.2:1, greater than or about 1.3:1, greater than or about 1.4:1, greater than or about 1.5:1, greater than or about 1.6:1, greater than or about 1.7:1, greater than or about 1.8:1, greater than or about 1.9:1, greater than or about 2.0:1, greater than or about 3.0:1, greater than or about 4.0:1, or greater. The concentration may be limited to these ranges, which may allow increased yttrium incorporation in the film, while limiting yttrium hydroxide precipitation. For example, further increased yttrium incorporation may increase yttrium hydroxide precipitation on the substrate. Unlike oxide formation, hydroxide incorporation may lower adhesion of the coating, and increase flaking of the coating. Accordingly, increasing the yttrium incorporation to a controlled level, as well as performing formation as explained below, may afford increased yttrium incorporation and improved structures throughout the coating.

As a consequence in conventional technologies, the most porous layer exterior layer may also be where the majority of yttrium resides, and which may be more readily removed by corrosion or erosion due to surface roughness. However, the present technology may increase the yttrium concentration, and may also adjust the deposition parameters to perform an oxidation over a longer period of time, such as greater than or about 1 hour, which may increase yttrium concentration throughout the coating. Hence, while conventional technologies may have limited yttrium incorporation below about 10 micrometers from a surface of the structure, the present technology may increase the concentration to greater depths through the structure, and may improve the incorporation.

The present technology may perform a process characterized by slower growth, which may increase interaction between the yttrium oxide and the aluminum oxide, and which may produce more stable structures. Additionally, by increasing the time at which the structure is exposed to the heat from plasma sparking, increased yttrium incorporation may be produced, which may allow greater incorporation of yttrium, as well as increased formation of a monoclinic yttrium aluminum as opposed to the garnet or perovskite forms. Accordingly, although it is to be understood that the time of formation may be related to the thickness of formation, in some embodiments the process may be performed for greater than or about 1 hour, and may be performed for greater than or about 2 hours, greater than or about 3 hours, greater than or about 4 hours, greater than or about 5 hours, greater than or about 6 hours, greater than or about 7 hours, greater than or about 8 hours, greater than or about 9 hours, greater than or about 10 hours, greater than or about 11 hours, greater than or about 12 hours, or more, where growth is performed more slowly, and which may increase yttrium incorporation. For example, aluminum oxide formation may occur readily during the formation process, and hence by slowing the growth, and increasing the heat and yttrium incorporation, yttrium may be incorporated sooner, and may be incorporated more consistently.

By performing deposition according to embodiments of the present technology, coatings may be produced to thicknesses of greater than or about 10 μm, and may be produced to thicknesses of greater than or about 20 μm, greater than or about 30 μm, greater than or about 40 μm, greater than or about 50 μm, greater than or about 60 μm, greater than or about 70 μm, greater than or about 80 μm, greater than or about 90 μm, greater than or about 100 μm, greater than or about 110 μm, greater than or about 120 μm, greater than or about 130 μm, greater than or about 140 μm, greater than or about 150 μm, or more. Producing coatings characterized by increased thickness may facilitate refurbishment and treatments, which may extend component lifetimes and may improve corrosion and/or erosion resistance. By providing an improved yttrium incorporation, material properties may similarly be improved over conventional technologies.

Figure 2:
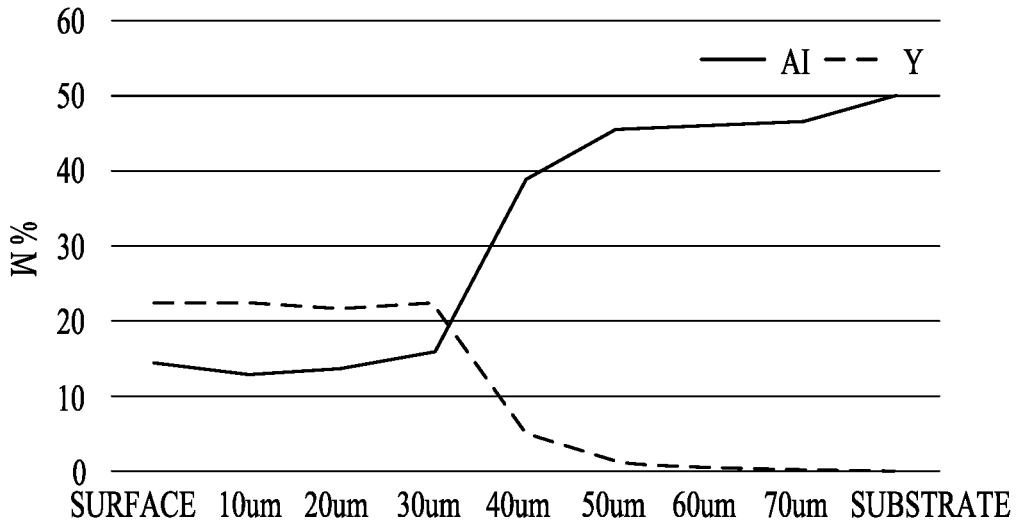
FIG. 2 shows a graph illustrating yttrium incorporation of an exemplary coating according to some embodiments of the present technology.

FIG. 2 shows a graph illustrating yttrium incorporation of an exemplary coating according to some embodiments of the present technology. It is to be understood that coatings according to some embodiments of the present technology may be characterized by a range of thicknesses and incorporation percentages as noted further below, although the graph illustrates one exemplary coating produced according to the present technology. As discussed above, conventional technologies may be characterized by reduced incorporation at depths beyond a superficial outer layer, which may also be characterized by worse material properties and flaking. However, the present technology may produce coatings having yttrium incorporations that may be greater than or about 10 at. % for depths that may exceed 20% of an overall depth of the coating over the substrate. As shown in the figure, for a non-limiting coating encompassed by the present technology, yttrium incorporation may exceed aluminum incorporation for a depth through the substrate, and may be characterized by consistent incorporation through a depth of the coating on a substrate.

In some embodiments, the yttrium incorporation may be greater than or about 10 at. % through a depth of up to about 50% of a thickness of the coating, or greater. For example, the yttrium incorporation according to some embodiments of the present technology may be greater than or about 12 at. %, and may be greater than or about 14 at. %, greater than or about 16 at. %, greater than or about 18 at. %, greater than or about 20 at. %, greater than or about 22 at. %, greater than or about 24 at. %, greater than or about 26 at. %, greater than or about 28 at. %, greater than or about 30 at. %, or higher, although in some embodiments the concentration may be limited to less than or about 30 at. %. Yttrium oxide may be characterized by a more fragile structure than a crystalline combination of yttrium oxide and aluminum oxide, and thus in some embodiments the incorporation may be controlled to maintain aluminum incorporation in the coating at greater than or about 10 at. %, and which may be maintained at greater than or about 11 at. %, greater than or about 12 at. %, greater than or about 13 at. %, greater than or about 14 at. %, greater than or about 15 at. %, or higher, throughout the coating.

The depth of the yttrium incorporation may also be maintained at any of the atomic incorporations noted above for a depth of greater than or about 10% from the surface of the overall coating depth to the substrate. Additionally, the incorporation may be maintained for a depth of greater than or about 12% of the depth through the coating, greater than or about 14% of the depth through the coating, greater than or about 16% of the depth through the coating, greater than or about 18% of the depth through the coating, greater than or about 20% of the depth through the coating, greater than or about 22% of the depth through the coating, greater than or about 24% of the depth through the coating, greater than or about 26% of the depth through the coating, greater than or about 28% of the depth through the coating, greater than or about 30% of the depth through the coating, greater than or about 32% of the depth through the coating, greater than or about 34% of the depth through the coating, greater than or about 36% of the depth through the coating, greater than or about 38% of the depth through the coating, greater than or about 40% of the depth through the coating, greater than or about 42% of the depth through the coating, greater than or about 44% of the depth through the coating, greater than or about 46% of the depth through the coating, greater than or about 48% of the depth through the coating, greater than or about 50% of the depth through the coating, or more. Further through the depth may be characterized by increased aluminum oxide incorporation, which may increase the hardness and adhesion of the coating before transitioning to the substrate, which may be aluminum or some other material.

By producing slower growth and increasing the exposure at higher temperatures, the present technology may produce a crystalline structure characterized by increased alpha aluminum oxide, as well as increased yttrium aluminum monoclinic material. For example, while garnet and perovskite forms of yttrium aluminum may be characterized by more thermodynamic equilibrium, the present technology may produce an increased monoclinic form, which may demonstrate kinetic equilibrium of the crystalline structure. This may lead to increase yttrium incorporation at further depths through the structure, which may greatly increase corrosion resistance compared to coatings of conventional technologies. In some embodiments, yttrium aluminum monoclinic incorporation may be greater than or about 2% in coatings according to the present technology, and the incorporation may be greater than or about 3%, greater than or about 4%, greater than or about 5%, greater than or about 6%, greater than or about 7%, greater than or about 8%, greater than or about 9%, greater than or about 10%, greater than or about 11%, greater than or about 12%, greater than or about 13%, greater than or about 14%, greater than or about 15%, or more.

By maintaining a composite yttrium oxide and aluminum oxide crystalline structure throughout the coating, improved material properties may be afforded by the present technology. For example, in some embodiments, coatings according to the present technology may be characterized by increased hardness over conventional technologies, and may be characterized by a Vickers hardness of greater than or about 1000, greater than or about 1200, greater than or about 1400, greater than or about 1600, greater than or about 1800, greater than or about 2000, or more. Additionally, the coatings may be characterized by increased dielectric breakdown voltage characteristics, which may facilitate use of the coatings on components that may be operated as an electrode in a semiconductor processing system. For example, coatings according to some embodiments of the present technology may be characterized by dielectric breakdown of greater than or about 20 V/μm, and may be characterized by dielectric breakdown of greater than or about 25 V/μm, greater than or about 30 V/μm, greater than or about 35 V/μm, greater than or about 40 V/μm, or greater. In some embodiments, this characteristic may be further increased by performing one or more post-processing operations.

As noted previously, exterior portions of the coatings may be characterized by aspersions or pores in the crystalline structure. By producing coatings according to the present technology, maximum and/or average pore diameters may be maintained at less than or about 100 nm, and may be maintained at less than or about 90 nm, less than or about 80 nm, less than or about 70 nm, less than or about 60 nm, less than or about 50 nm, less than or about 40 nm, less than or about 30 nm, less than or about 20 nm, less than or about 15 nm, less than or about 12 nm, less than or about 10 nm, less than or about 8 nm, or less. This may produce a surface roughness of the coatings, which may increase degradation during exposure to plasma effluents, for example, and which may produce an average surface roughness of up to or about 2 μm. To improve this roughness, in some embodiments additional processing may be performed.

In some embodiments, after a sufficient depth of coating has been produced, the oxidation process may be halted, and the substrate may be removed, washed, and/or otherwise cleaned. Subsequently, the coated component may be transferred to one or more additional chambers at optional operation 120, where post-processing may be performed. As one exemplary process that may be performed subsequent to the coating process, a polishing operation may be performed at optional operation 125, which may be performed to remove an amount of material from the surface of the coating. The polishing operation may be performed by a chemical-mechanical polishing or other abrasive technique, which may remove a surface of the coating, such as up to a few micrometers of coating.

While such an operation may essentially remove the yttrium-containing portion of the coating in conventional technologies, removal with coatings according to the present technology may improve surface roughness, while having limited or no effect on the surface composition, which may extend to a greater depth of the structure. Yttrium may provide a more corrosion resistant surface as compared to other materials, and thus, by maintaining yttrium concentration utilizing coatings according to embodiments of the present technology, removing a surface may maintain a yttrium-rich coating at the surface, while reducing roughness, which may further improve corrosion resistance by limiting penetration and adhesion surfaces for halogens or other corrosive materials. By performing a removal or planarization according to some embodiments of the present technology, average surface roughness may be limited to less than or about 1 μm, and may be limited to less than or about 0.50 μm, less than or about 0.25 μm, less than or about 0.10 μm, or less, across a surface of the coating.

As explained previously, the present technology may produce coatings that may be applied to components defining apertures or other features across surfaces of the component. While a planarization process may reduce roughness across some surfaces of the component, the process may be incapable of addressing roughness of the coating within features of the component. Accordingly, in some embodiments a subsequent process may be performed to improve coating through pores of the coating. In some embodiments, the component may be transferred to a chamber in which atomic-layer deposition may be performed at optional operation 130, as a second coating overlying the oxide material, which may be a first coating on the component.

As explained previously, the present technology may produce conformal coatings, which may extend across any variety of features and aspects of components, unlike spray-coating techniques. Atomic-layer deposition may also form conformal coverage across a substrate. However, coatings formed by atomic-layer deposition may be characterized by thicknesses of less than or about several hundred nanometers, which may limit the amount of bombardment that may be resisted by the coating. Additionally, atomic-layer deposition may produce amorphous films, which may be characterized by reduced hardness and breakdown voltage compared to crystalline structures. Consequently, atomic-layer deposited coatings may be incapable of the physical and material properties of coatings used as a first coating layer in embodiments of the present technology. However, atomic-layer deposited coatings may be characterized by improved surface coverage, such as without pores or reduced aspersions, due to the amorphous nature of the coverage. Accordingly, atomic-layer deposited films may be afford benefits to electrical characteristics, which may be impacted by coatings according to embodiments of the present technology.

For example, as explained above, oxide coatings formed according to some embodiments of the present technology may be characterized by a pore structure that may extend into the coating. This may provide increased adhesion surfaces for corrosive material, and may provide paths for breakdown at lower voltages. However, in some embodiments, a second yttrium-containing layer may be formed overlying the yttrium-containing oxide coating previously formed, and may be formed by atomic-layer deposition, which may afford sealing of the coating along all surfaces of the component, including in complex geometries and apertures. As explained above, pore formation in the first layer oxides may be limited in maximum pore size and average pore size, which may allow a limited fill by atomic-layer deposition, while maintaining the previous coating that may be several orders of magnitude thicker than may be produced in similar times by atomic-layer deposition, and may produce a harder crystalline structure.

In some embodiments, a layer of yttrium-containing material, such as yttrium oxide, may be formed by atomic-layer deposition over the oxide layer originally formed. The formation may be produced with a yttrium-containing precursor and/or an oxygen-containing precursor by any number of atomic-layer deposition processes that may produce a conformal coating. This may produce a combination coating on the component, which may have a number of beneficial characteristics. For example, in addition to the hardness provided by the crystalline structure, by filling pores in the surface, the already enhanced breakdown voltage may be further increased. The atomic-layer deposition may be formed to a thickness of less than or about 100 nm over the oxide coating of any thickness described above, and may be formed to a thickness of less than or about 90 nm, less than or about 80 nm, less than or about 70 nm, less than or about 60 nm, less than or about 50 nm, less than or about 40 nm, or less. By producing the secondary coating, the dielectric breakdown characteristics may be substantially improved.

In some embodiments, the combination coating may be characterized by a dielectric breakdown voltage of greater than or about 40 V/μm, and may be characterized by a dielectric breakdown voltage of greater than or about 42 V/μm, greater than or about 44 V/μm, greater than or about 46 V/μm, greater than or about 48 V/μm, greater than or about 50 V/μm, greater than or about 52 V/μm, greater than or about 54 V/μm, greater than or about 56 V/μm, greater than or about 58 V/μm, greater than or about 60 V/μm, or more. This may allow components having coatings according to some embodiments of the present technology to be used as high-voltage electrodes in future systems and devices.

Figure 3:
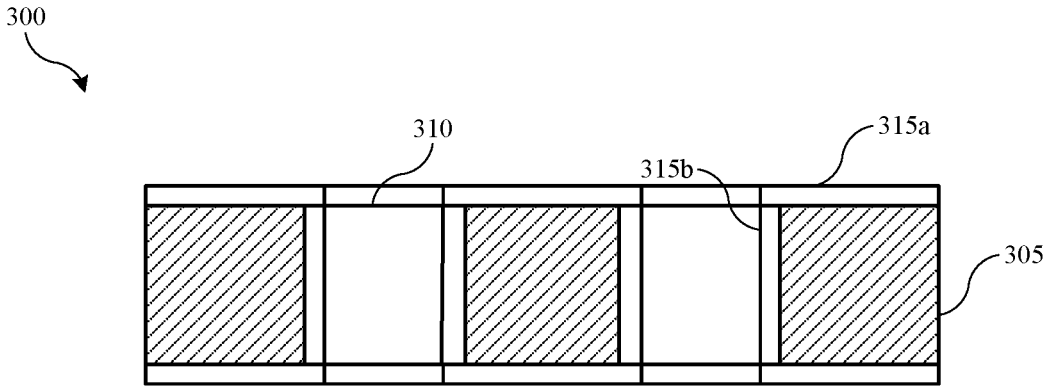
FIG. 3 shows a schematic cross-sectional view of a component including an exemplary coating according to some embodiments of the present technology.

FIG. 3 shows a schematic cross-sectional view of a component 300 including an exemplary coating according to some embodiments of the present technology, and which may include any feature, aspect, or characteristics of components or coatings as previously described. For example, the component may include a substrate 305, which may be or include aluminum, or any other material that may be used in semiconductor processing. The component may define one or more apertures 310. Although a component with apertures is illustrated, it is to be understood that the present technology may similarly encompass components defining trenches, channels, fluid paths, or any other feature. As explained previously, coatings according to some embodiments of the present technology may be produced conformally across surfaces of a substrate, regardless of the topography of the component. As illustrated, an oxide coating may cover planar surfaces, such as portion 315*a* of the coating, as well as within features of the component, such as portion 315*b* of the coating. Accordingly, coatings characterized by any aspect or feature discussed above may be formed to a similar thickness along any surface or feature of a component, and any two locations along the coating may be characterized by a thickness within 90% of each other, and may be characterized by a thickness within 92% of each other, within 94% of each other, within 96% of each other, within 98% of each other, within 99% of each other, or essentially equivalent to each other within a margin of error for any measurement device or technology being used.

Figure 4:
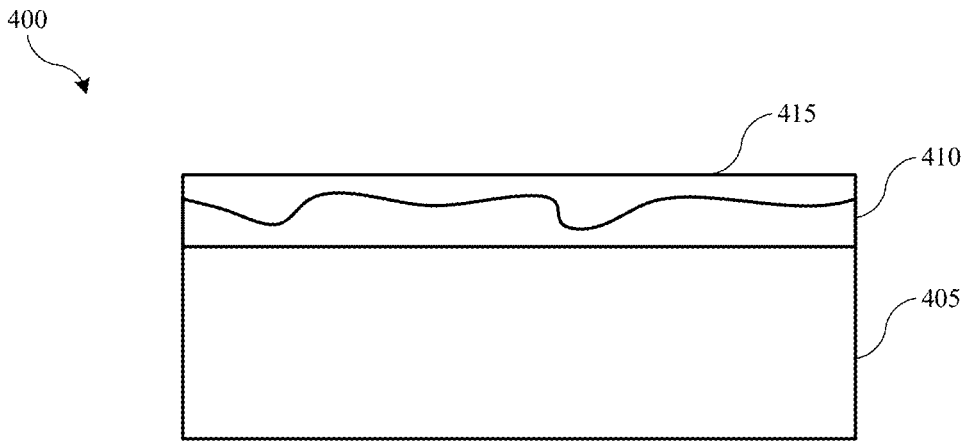
FIG. 4 shows a schematic cross-sectional view of a component including an exemplary coating according to some embodiments of the present technology.

FIG. 4 shows a schematic cross-sectional view of a component 400 including an exemplary coating according to some embodiments of the present technology, and which may include any feature, aspect, or characteristic of components or coatings as previously described. Component 400 may be illustrated with a combination coating as discussed previously. For example, component 400 may include a substrate 405, which although shown as a planar material, may similarly include or define any number of features or characteristics along the component. Overlying the substrate may be a first conformal coating layer 410, which may include a yttrium-containing oxide coating as discussed above. Because the surface of the coating layer 410 may be characterized by pores, a second conformal coating layer 415 may be formed overlying the first conformal coating. The second conformal coating may be produced by atomic layer deposition as discussed above, and may fill the pores to improve properties as discussed above. Either before and/or after the second conformal coating, a polishing operation may be performed as discussed above to planarize a surface of the coating in some embodiments. By producing coatings according to some embodiments of the present technology, increased component protection may be afforded.

In the preceding description, for the purposes of explanation, numerous details have been set forth in order to provide an understanding of various embodiments of the present technology. It will be apparent to one skilled in the art, however, that certain embodiments may be practiced without some of these details, or with additional details.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where neither of the limits, either limit, or both limits are included in the smaller ranges is also encompassed within the technology, subject to any specifically excluded limit in the stated range. Where the stated range includes one or both of the limits, ranges excluding either or both of those included limits are also included.

As used herein and in the appended claims, the singular forms "a", "an", and "the" include plural references unless the context clearly dictates otherwise. Thus, for example, reference to "a layer" includes a plurality of such layers, and reference to "the precursor" includes reference to one or more precursors and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

The invention claimed is:

1. A method of coating a semiconductor component substrate, the method comprising:

submerging the semiconductor component substrate in an alkaline electrolyte, wherein the alkaline electrolyte comprises yttrium;

igniting a plasma at a surface of the semiconductor component substrate for a period of time less than or about 12 hours; and forming a yttrium-containing oxide on the semiconductor component substrate, wherein a surface of the yttrium-containing oxide is characterized by a yttrium incorporation of greater than or about 10 at. %, and wherein the yttrium-containing oxide formed by submerging the semiconductor component substrate in the alkaline electrolyte and igniting a plasma at a surface of the semiconductor component substrate comprises pores characterized by an average pore diameter of less than or about 100 nm.

2. The method of coating a semiconductor component substrate of claim 1, wherein the semiconductor component substrate comprises an aluminum alloy.

3. The method of coating a semiconductor component substrate of claim 1, wherein the yttrium incorporation in the yttrium-containing oxide is maintained above or about 10 at. % through at least one third of a depth of the yttrium-containing oxide.

4. The method of coating a semiconductor component substrate of claim 1, wherein the yttrium-containing oxide on the semiconductor component substrate is characterized by a Vickers hardness of greater than or about 1000.

5. The method of coating a semiconductor component substrate of claim 1, wherein the yttrium-containing oxide on the semiconductor component substrate is characterized by a dielectric breakdown voltage of greater than or about 20V/μm.

6. The method of coating a semiconductor component substrate of claim 1, wherein the yttrium-containing oxide formed comprises pores characterized by an average pore diameter of less than or about 50 nm.

7. The method of coating a semiconductor component substrate of claim 1, further comprising:

forming a yttrium-containing layer on the yttrium-containing oxide by an atomic layer deposition process to produce a combination coating on the semiconductor component substrate.

8. The method of coating a semiconductor component substrate of claim 7, wherein the yttrium-containing layer is characterized by a thickness of less than or about 100 nm.

9. The method of coating a semiconductor component substrate of claim 7, wherein the combination coating on the semiconductor component substrate is characterized by a dielectric breakdown voltage of greater than or about 50 V/μm.

10. The method of coating a semiconductor component substrate of claim 1, further comprising:

removing an amount of the yttrium-containing oxide across a surface of the semiconductor component substrate.

11. The method of coating a semiconductor component substrate of claim 10, wherein the yttrium-containing oxide across the surface is characterized by an average roughness of less than or about 0.5 μm.

12. A method of coating a semiconductor component substrate, the method comprising:

submerging the semiconductor component substrate in an alkaline electrolyte, wherein the alkaline electrolyte comprises yttrium;

igniting a plasma at a surface of the semiconductor component substrate for a period of time less than or about 12 hours; and forming a yttrium-containing oxide on the semiconductor component substrate, wherein the yttrium-containing oxide is characterized by a thickness of greater than or about 50 um, wherein the yttrium-containing oxide is characterized by a Vickers hardness of greater than or about 1000, and wherein the yttrium-containing oxide on the semiconductor component substrate is characterized by a dielectric breakdown voltage of greater than or about 20 V/μm.

13. The method of coating a semiconductor component substrate of claim 12, wherein a yttrium incorporation in the yttrium-containing oxide is maintained above or about 10 at. % through at least one third of a depth of the yttrium-containing oxide.

14. The method of coating a semiconductor component substrate of claim 12, further comprising:

polishing a surface of the yttrium-containing oxide across the semiconductor component substrate.

15. The method of coating a semiconductor component substrate of claim 14, wherein the surface of the yttrium-containing oxide across the semiconductor component substrate is characterized by an average roughness of less than or about 0.5 μm.

16. The method of coating a semiconductor component substrate of claim 12, further comprising:

forming a yttrium-containing layer on the yttrium-containing oxide by an atomic layer deposition process to produce a combination coating on the semiconductor component substrate.

17. The method of coating a semiconductor component substrate of claim 16, wherein the yttrium-containing layer on the yttrium-containing oxide is characterized by a thickness of less than or about 100 nm.

18. The method of coating a semiconductor component substrate of claim 16, wherein the combination coating on the semiconductor component substrate is characterized by a dielectric breakdown voltage of greater than or about 50 V/μm.

19. The method of coating a semiconductor component substrate of claim 12, wherein the yttrium-containing oxide is characterized by a Vickers hardness of greater than or about 2000.

* * * * *